US008602584B2

(12) United States Patent
Ghafoori et al.

(10) Patent No.: US 8,602,584 B2
(45) Date of Patent: Dec. 10, 2013

(54) CONE LIGHT

(75) Inventors: Azim Zadah Ghafoori, Fullerton, CA (US); Joel Timothy Morgan, Cloverdale, CA (US)

(73) Assignee: Project AJ, Inc., Fullerton, CA (US)

( * ) Notice: Subject to any disclaimer, the term of this patent is extended or adjusted under 35 U.S.C. 154(b) by 0 days.

(21) Appl. No.: 13/419,956

(22) Filed: Mar. 14, 2012

(65) Prior Publication Data

US 2013/0241419 A1 Sep. 19, 2013

(51) Int. Cl.

| | |
|---|---|
| ***F21V 21/00*** | (2006.01) |
| ***G08G 1/09*** | (2006.01) |
| ***H05B 39/09*** | (2006.01) |

(52) U.S. Cl.

USPC ..... 362/157; 362/183; 362/186; 362/249.02; 362/253; 315/200 A; 315/154

(58) Field of Classification Search

USPC ..... 315/152–155, 200 A, 209 R, 210, 219; 362/157, 183, 186, 190, 191, 234, 228, 362/249.02, 253, 267; 116/63 C, 63 P, 63 R

See application file for complete search history.

(56) References Cited

U.S. PATENT DOCUMENTS

| | | | | |
|---|---|---|---|---|
| 3,819,924 | A | 6/1974 | Thomas et al. | 240/2 |
| 5,469,342 | A | 11/1995 | Chien | 362/84 |
| 6,292,901 | B1 | 9/2001 | Lys et al. | 713/300 |
| 6,499,858 | B2 | 12/2002 | Hart | 362/183 |
| 6,753,762 | B1 * | 6/2004 | Jorba Gonzalez | 340/333 |
| 7,538,688 | B1 * | 5/2009 | Stewart | 340/908 |
| 7,878,678 | B1 | 2/2011 | Stamatatos et al. | 362/184 |
| 7,997,764 | B1 * | 8/2011 | Nielson | 362/249.02 |
| 8,232,732 | B2 * | 7/2012 | Bolzan | 315/200 A |
| 2004/0218381 | A1 | 11/2004 | Sawyer et al. | 362/157 |
| 2007/0176784 | A1 | 8/2007 | Fautin et al. | 340/686.1 |
| 2011/0133655 | A1 | 6/2011 | Recker et al. | 315/159 |

OTHER PUBLICATIONS

Turboflare product literature (undated), 4pp.

Turboflare webpage (undated), 6pp (www.turboflareinternational.com).

* cited by examiner

*Primary Examiner* — Vibol Tan

(74) *Attorney, Agent, or Firm* — Dergosits & Noah LLP

(57) ABSTRACT

A cone light is a light emitting structure that is placed on a traffic cone to improve the visibility of the traffic cone. The light cone includes a plurality of lights that are mounted to an outer surface of the cone light and a micro-controller that controls the illumination of the lights. The cone light also has a memory storing a plurality of flash patterns and the micro-controller illuminates the lights in the flash pattern selected by the user. Multiple cone lights can be used together with a master cone light transmitting a flash pattern signal to one or more slave cone light so that each of the cone lights is illuminated in a matching or coordinated pattern.

20 Claims, 9 Drawing Sheets

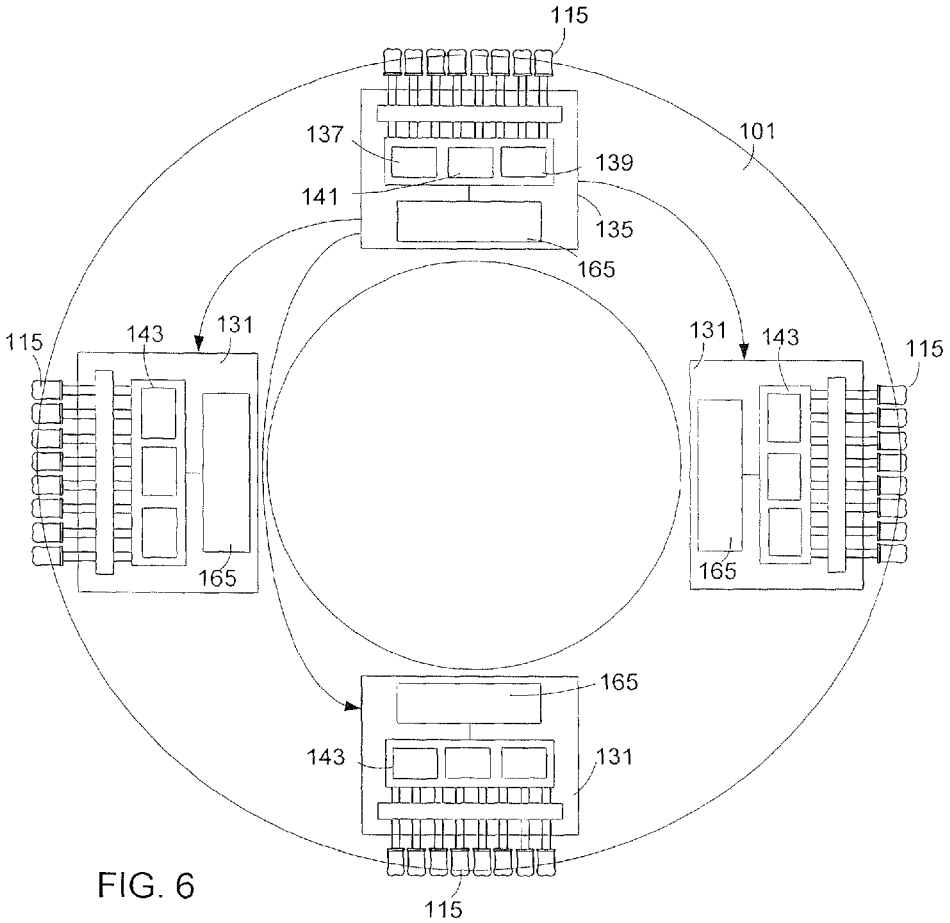
FIG. 6
FIG. 7
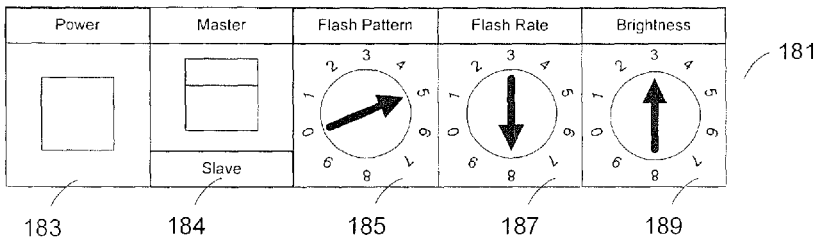

CONE LIGHT

BACKGROUND

Traffic cones, also called traffic pylons, road cones, highway cones, safety cones, construction cones are usually cone-shaped markers that are placed on roads or footpaths to temporarily redirect traffic in a safe manner. They are often used to create separation or merge lanes during road construction projects or automobile accidents. Traffic cones are usually made in bright colors to be highly visible. However, a problem with traffic cones is that they may not be visible at night. For night time use or low-light areas traffic cones are usually fitted with a reflective material or coating to increase visibility. Although traffic cones have improved visibility when a light is shined on the reflective material, these traffic cones may not be very visible at night without the incident light of a car headlight, a street light, a flashlight or another light source. What is needed is a light that can be placed on traffic cones to improve the visibility of the traffic cones at night.

SUMMARY OF THE INVENTION

The present invention is directed towards a cone light apparatus which is placed on a traffic cone to improve the visibility of the cone at night. In an embodiment, the cone light includes an annular body which has an inner diameter and the annular body can have an internal volume. The inner diameter of the cone light can be smaller than the outer diameter at the lower portion of the traffic cone. Thus, when placed over the traffic cone, the cone light rests on the conical outer surface of a traffic cone at an elevated position. In other embodiments, the cone light can include straps or other mechanisms for supporting the cone light in an elevated position on the traffic cone.

A plurality of lights can be mounted to an outer surface of the cone light body proximate the outer diameter. In an embodiment, the lights can be arranged in groups with each of the lights aligned with the center line of the cone light body. For example, each group of lights can include between 1 and 20 lights which are arranged in a linear pattern. In other embodiments, the lights can be arranged in non-linear pattern groups on the outer surface of the cone light body. The lights may emit light in directions that extend above or below the horizontal center line of the cone light.

The lights can be light emitting diodes (LEDs) or in other embodiments, the lights can be: fluorescent, incandescent, halogen, or any other suitable type of light. The lights can also have a fixed color such as white, red, yellow, etc. However, it is also possible to use a composite light which may include red, green and blue light sources in a close proximity. By varying and light output produced by each of the red, green and blue light sources, the composite light will appear to be any a uniform color rather than individual red, green and blue lights. The composite light can produce a wide variety of colors.

The lights can be coupled to an edge of a master control board or the edges of slave control boards which can be coupled to an electric power supply such as a battery. The lights can be illuminated in a flash pattern by the master control board and the slave control boards. In an embodiment, a first set of the lights of the cone light apparatus can be coupled to a master control board and other sets of lights can be coupled to slave light boards. The lights can be coupled to one edge of the master and slave control boards. The control boards can be positioned within the body of the cone light with the light edges of the boards mounted proximate the outer diameter facing outward. The master control board can also include a micro-controller and a switch that allows a user to adjust the light output from the cone light apparatus. The controller may include an on/off button and switches or controls for adjusting the flash pattern, flash rate and brightness.

The selected flash pattern, flash rate and light settings for the lights can be transmitted to a micro-controller which can actuate the lights coupled to the master control board according to the switch settings. The master control board can also transmit the flash pattern, the flash rate and the light output as flash pattern signals to the slave control boards. The lights coupled to the slave light board can be illuminated in the same flash pattern as the master light control board. In this configuration, each group of lights on the cone light will be illuminated in the same pattern simultaneously.

However, in other embodiments, the lights of the slave boards may be actuated asynchronously to the master control board lights. For example, the slave board lights may be illuminated in a sequential manner rather than simultaneously with the master control board. In a sequential illumination mode, the lights of the master light control board can be illuminated first for a predetermined period of time, then the lights of the adjacent slave control board and then the lights of the next slave control board. In this configuration, the lights may appear to rotate around the cone light apparatus.

A plurality of flash patterns may be stored in a memory coupled to the micro-controller. These flash patterns can be preprogrammed into the memory. Alternatively, the cone light may have an interface which allows the users to design or download different flash patterns through a computer or other electronic device. These created or downloaded flash patterns can then be stored in the memory and used to illuminate the lights.

In other embodiment multiple cone lights can be used together in a coordinated manner. One of the cone lights can be a master cone light that transmits flash pattern signals to one or more slave cone lights so that the same flash pattern can be repeated by the master cone light and a plurality of slave cone lights. In an embodiment, a master cone light may include a transmitter which can transmit light control signals to one or more slave cone lights which each have receivers. The transmitter and receivers can operate through a direct electrical connection, radio frequency signals, optical signals or any other suitable communication means.

The slave cone lights can be illuminated in the same light flash pattern as the master cone light or in a different flash pattern according to the light flash control signals transmitted by the master cone light apparatus. The illumination of the slave cone lights can also be virtually simultaneous to the master cone light or sequential.

BRIEF DESCRIPTION OF THE DRAWINGS

FIG. 6 illustrates a cross section view of an embodiment of the cone light;

FIG. 7 illustrates a view of switches for controlling the lights in the cone light;

DETAILED DESCRIPTION

Figure 1:
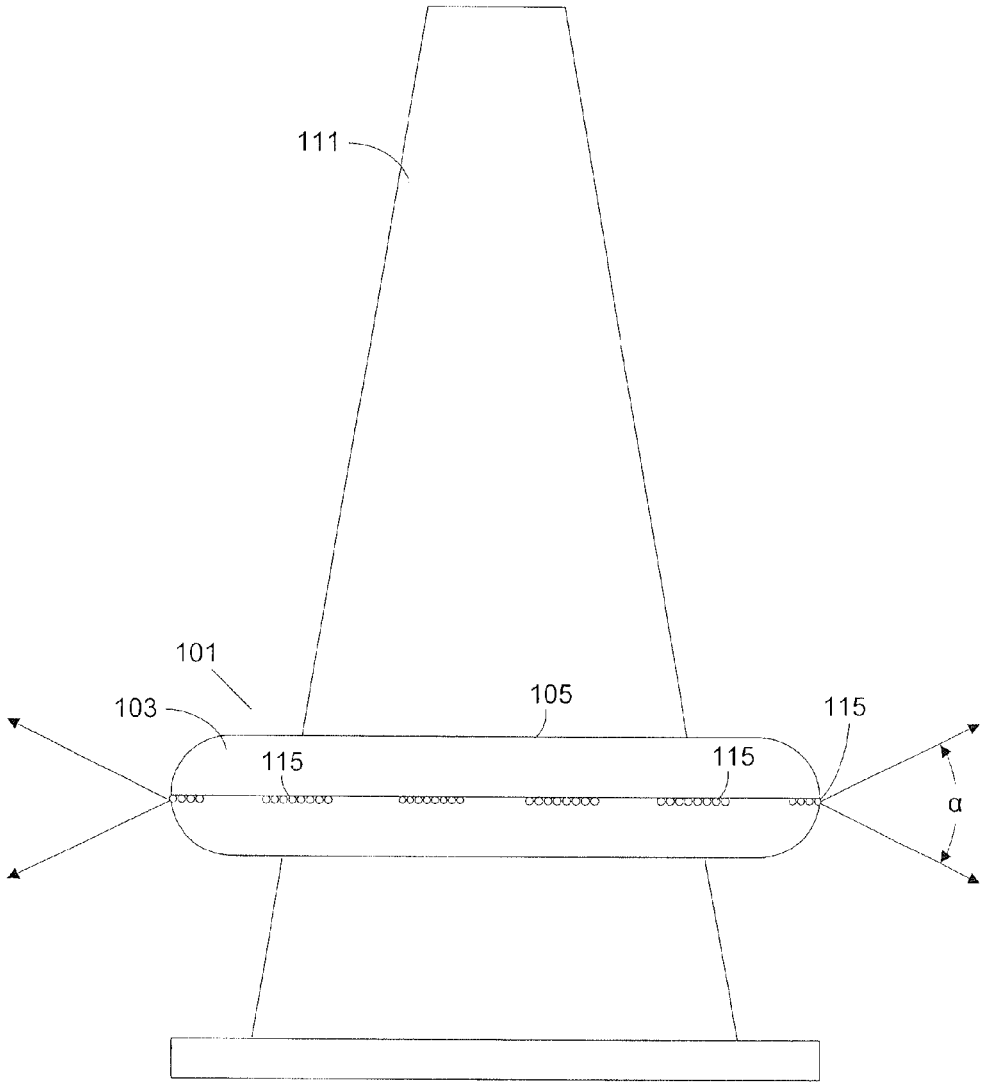
FIG. 1 illustrates an embodiment of a cone light on a traffic cone.

With reference to FIG. 1, in an embodiment the cone light 101 on a traffic cone 111 is illustrated. The traffic cone 111 can be made of a flexible plastic material and have a bright color such as orange or yellow and a large base attached to the bottom portion for improved stability. The traffic cone 111 can be partially covered with a reflective material which reflects light from the headlights of motor vehicles or other light sources making the traffic cone more visible at night. However, without a light source the traffic cone 111 may not be visible at night or in a dark location. By placing a cone light 101 over the traffic cone 111 and illuminating the lights 115, the visibility of the traffic cone 111 is greatly improved.

In an embodiment, the cone light 101 can have an annular body 103 that includes a center hole 105 that has an inner diameter that corresponds to an outer diameter of a middle section of a traffic cone 111. A traffic cone 111 may be about 28 inches high and have an outer diameter of about 4 inches at the upper portion of the cone 111 and an outer diameter of about 12 inches at the lower portion of the cone 111. In an exemplary embodiment, the cone light 101 may have an inner diameter of about 9 inches, an outer diameter that is about 15 inches and a circular cross section that is about 3 inches in diameter. When the cone light 101 is placed on the traffic cone 111, it can rest on the middle section of the traffic cone 111 elevated above the ground for improved visibility. In other embodiments, the inner diameter, the outer diameter and the cross section can be any other suitable dimensions and the general shape of the cone light 101 can be a polygon rather than a circle. Although the cone light is illustrated and described as surrounding a portion of the cone, in other embodiments the cone light may only extend around a portion of the circle or polygon's 360 degrees. The body of the cone light may have a "C" configuration that extends less than 360 degrees but more than 180 degrees. The cone light body may have an opening that is less than 180 degrees.

When illuminated, the lights 115 emit light rays from the cone light 101 within an angle range $\alpha$. The angle $\alpha$ may range between about 30 and 120 degrees. The angle $\alpha$ can be controlled by the type of lights 115 being used or possibly by a lens which can alter the directions of the light rays. The cone light 101 will be most visible if the viewer is within angle range a so that some of the emitted light reaches the viewer. The light rays can also be angled downward to illuminate portions of the street that need to be seen by drivers or pedestrians. Alternatively, the lights 115 may also be angled upward so that more light is transmitted further away from the traffic cone 111.

Figure 2:
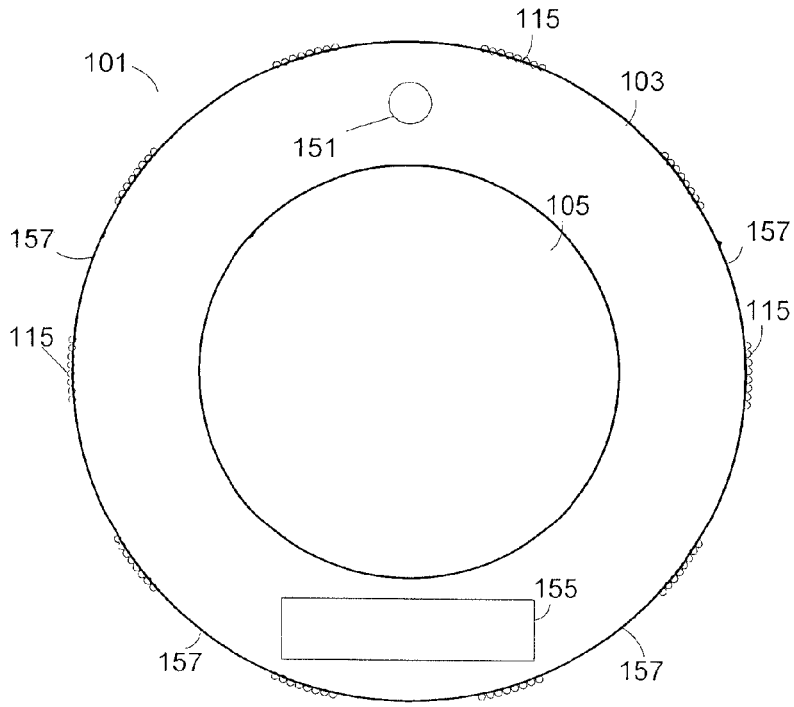
FIG. 2 illustrates a top view of an embodiment of the cone light.
Figure 3:
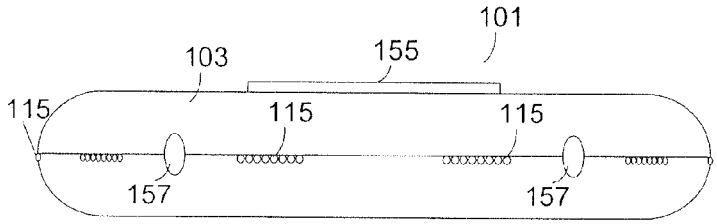
FIG. 3 illustrates a side view of an embodiment of the cone light.
Figure 4:
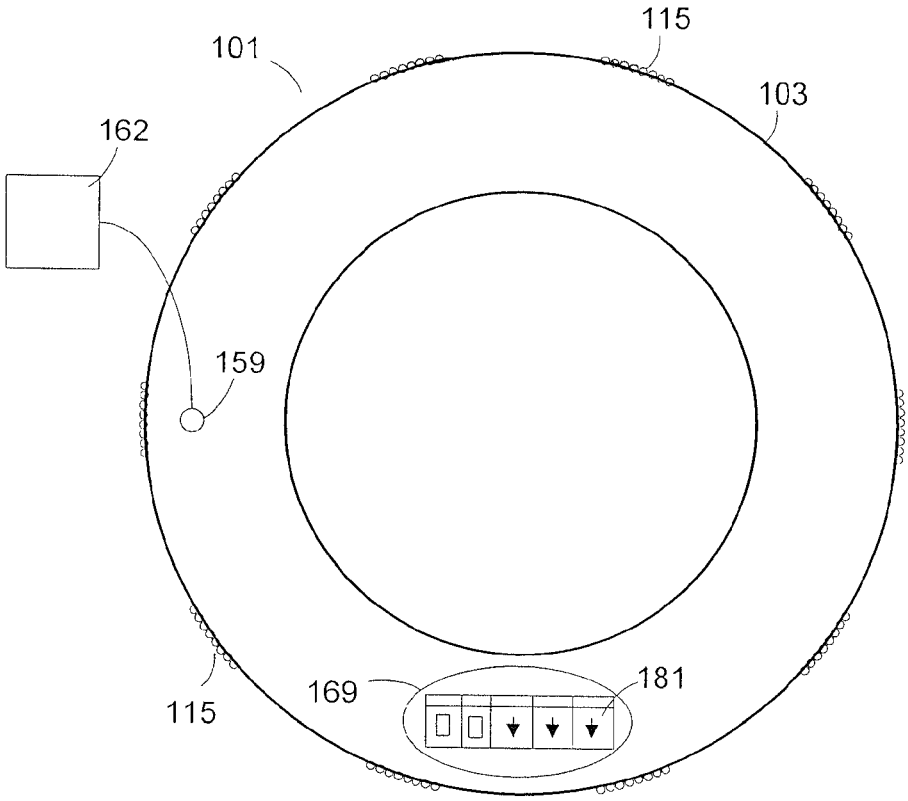
FIG. 4 illustrates a bottom view of an embodiment of the cone light.

FIG. 2 is a top cross view, FIG. 3 is a side view and FIG. 4 is a bottom view of an embodiment of the cone light 101. The cone light 101 can include a plurality of lights 115 that are mounted around the outer diameter of the body of the cone light 101. The lights 115 may be arranged in groups 117 which can be mounted to the body and evenly spaced around the cone light 101. In the illustrated example, there are ten groups of lights 115 positioned around the outer diameter of the cone body 103 and there are eight lights 115 in each group. In other embodiments, there can be any number of groups and any number of lights 115 in each group.

Figure 5:
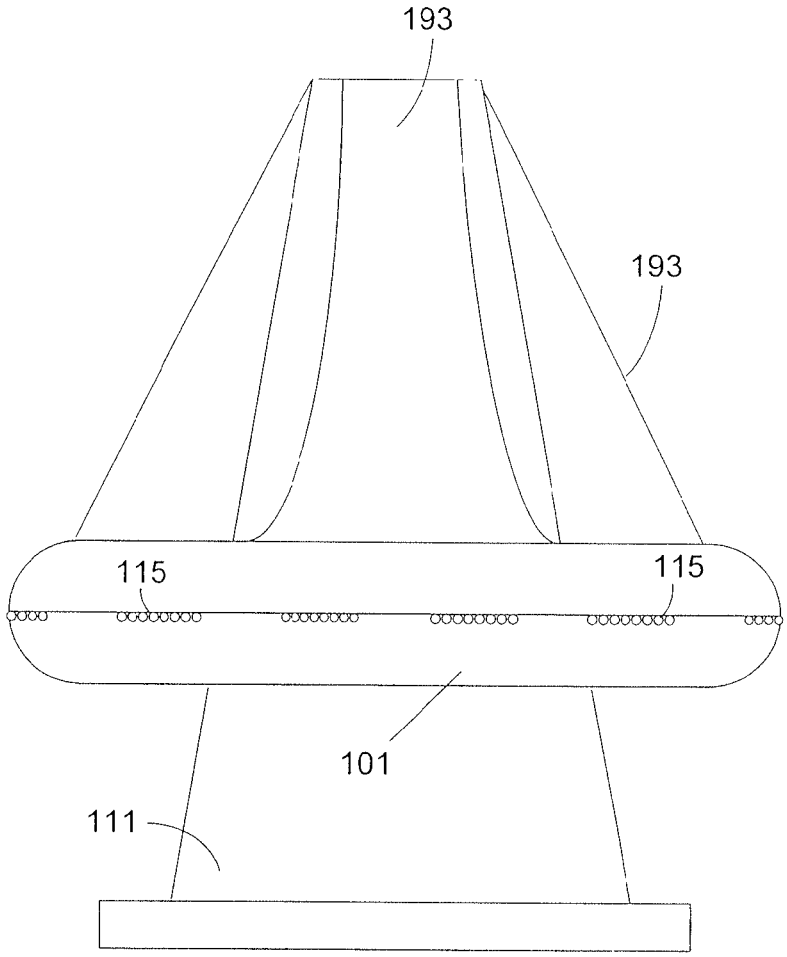
FIG. 5 illustrates a side view of an embodiment of the cone light having support straps.

In some applications, the cone light 101 may not rest on the traffic cone at the desired elevation on the traffic cone 111 because the outer diameter of the traffic cone 111 may be smaller than the inner diameter of the cone light 101. A mechanical device may be needed to elevate the cone light 101. With reference to FIG. 5, in an embodiment, the cone light 101 can be coupled to a strap system 193 that is attached to the body of the cone light 101. The strap system 193 can extend over the top of the traffic cone 111 and be coupled to the body 103 of the cone light 101. The straps of the strap system 193 adjustable so that the cone light 101 can be supported at any height. The strap system 193 can be made of a reflective material to further improve the visibility of the traffic cone 111.

With reference to FIG. 6, a cross section view of an embodiment of the cone light 101 is illustrated with a simplified view of a master light control board 135 and a plurality of slave light boards 131. The master light control board 135 and the plurality of slave light boards 131 are each coupled to a group of lights 115 which can be mounted on one edge of the light boards 131, 135 which can be oriented so that the lights 115 protrude outward from the outer diameter of the cone light 101. The master light control board 135 can include a micro-controller 139 which can control the flash pattern, the flash rate and the light output of the lights 115 coupled to the master light control board 135. The master light control board 135 can also communicate with the other light boards 131. Once the flash pattern is set by a user, the master light control board 135 can transmit flash pattern, flash rate and light output signals to the slave light boards 131 which can illuminate their lights 115 in the flash pattern set by the user. These light control signals can be electrical signals transmitted through wired connections between the master light control board 135 and the slave light boards 131. Alternatively, the wireless signals can be can be radio frequency ("RF") signals or optical signals transmitted through an optical fiber. These light control signals can be sent from a transmitter 141 on the master light control board 135 to receivers 143 on the slave light boards 131.

The lights 115 can be controlled by the master light control board 135 to output different light power output, color, etc. The light power output can be proportional to the electrical current applied to the light. In an embodiment, each of the lights 115 can include a red LED, a green LED and a blue LED. The master light control board 135 can control the electrical current and the light output the red, green and blue colors in each light so that the mixed light can appear to be almost any color. Thus, the color of the light emitted by each light 115 can be controlled by the master light control board 135.

With reference to FIG. 4, in an embodiment, switches 181 having a plurality of light flash pattern controls is coupled to the master light control board. The switches 181 can be mounted on the bottom of the cone light body and may be within a recessed area 169 to avoid direct exposure to rain, snow, etc. A removable cover 165 may also be placed over switches 181 for further protection. A user may control the flash pattern of the cone light by adjusting the settings on the switches 181 which are coupled to the master light control board.

With reference to FIG. 7, a more detailed view of an embodiment of the switches 181 is illustrated. The switch 181 can include a power switch 183 for turning the cone light on or off, a master/slave switch 184 for setting the operating mode of the cone light, a flash pattern control 185 for setting the flash pattern, a flash rate control 187 for adjusting the flash rate and a brightness control 189 for adjusting the brightness of the lights. The power switch 183 can be turned on to illuminate the lights and turned off to extinguish the lights and conserve the batteries.

The master/slave switch 184 can control the operating mode of the cone light. When the master/slave switch 184 is set to master, a transmitter in the cone light transmits flash pattern signals to other cone lights. When the master/slave switch 184 is set to slave, a receiver in the cone light receives the flash pattern signals. The master or slave settings can be necessary when multiple cone lights are used together. These multiple cone light systems will be described in more detail later. The flash pattern control 185 may include a dial indicator with a plurality of numbers which each correspond to a different flash pattern. The user may manually turn the dial indicator to the number corresponding to the desired flash pattern. Alternatively, the user can turn the dial indicator to each flash pattern number and see the flash pattern produced by the cone light and then set the dial indicator on the desired flash pattern. In other embodiments, any other type of selector switch can be used such as a slide, push button, toggle, etc.

The flash rate control 187 can be configured with lower flash rate switch numbers corresponding to a slower flash rate for the lights and the higher number corresponding to a faster flash rate. The zero setting may keep the light illumination constant rather than flashing. The flash rate settings of 1-9 may correspond to a range of flash rates from a slow rate of about one flash per several seconds to a fast rate of one flash per a fraction of a second. In this example, the flash rate has been set to 8 which can be a relatively fast flash rate.

The brightness control 189 may alter the brightness output of the lights in the cone light. A low brightness setting number may correspond to a lower light output and a high brightness setting may correspond to a high lumen output from the lights. In this example, the brightness control 189 has been set to 3 which can be a lower brightness setting to conserve battery power.

As discussed above, the master light control board 135 can cause the lights 115 to emit various types of flash patterns and in FIG. 7, the user has set the flash pattern to 5. In the illustrated example, the light boards 131, 135 may each hold 8 individual lights 115. These lights 115 can be illuminated in any combination of colors, flash rates, brightness, patterns, etc. In an embodiment, 10 different flash patterns can be stored in a memory 137 of the master light control board 135. A first example flash pattern may have all eight lights simultaneously turning on in a red color at time 1 and then turning all lights off at time 2. This sequence can be repeated while the cone light is on. The time durations of time 1 and time 2 can be equal. This flash pattern can be represented by table 1 with the lights 115 being turned on or off depending upon the repeating Time 1-2 sequence. Because a single color is being used, all of the lights 115 can be red LEDs.

TABLE 1

| | Light 1 | Light 2 | Light 3 | Light 4 | Light 5 | Light 6 | Light 7 | Light 8 |
|---|---|---|---|---|---|---|---|---|
| Time 1 | On Red | On Red | On Red | On Red | On Red | On Red | On Red | On Red |
| Time 2 | Off | Off | Off | Off | Off | Off | Off | Off |

A second example flash pattern can include four time periods. Time 1 can include turning on lights 1 and 2 in orange, turning on lights 5 and 6 in green and turning other lights off at time 1. At time 2, the pattern can include turning on light 3 in green, turning on light 7 in orange and turning off all other light. At time 3, the pattern can include turning on light 1 in orange and light 5 in green and turning off all other lights. At time 4, the pattern can include turning on lights 3 and 4 in green, lights 7 and 8 in orange and turning off all other lights. As shown in Table 2. This flash pattern may simulate light movement and attract more attention than the simple flash pattern described above. All eight lights can have fixed colors. Lights 1, 2, 7 and 8 can be orange and lights 3-6 can be green,

TABLE 2

| | Light 1 | Light 2 | Light 3 | Light 4 | Light 5 | Light 6 | Light 7 | Light 8 |
|---|---|---|---|---|---|---|---|---|
| Time 1 | On Orange | On Orange | Off | Off | On Green | On Green | Off | Off |
| Time 2 | Off | Off | On Green | On | Off | Off | On Orange | On |
| Time 3 | On Orange | Off | Off | Off | On Green | Off | Off | Off |
| Time 4 | Off | Off | On Green | Off Green | Off | Off | On Orange | Off Orange |

A third example flash pattern shown in Table 3 can create an illusion of a white light and a red light rotating around the cone light. In this embodiment, lights can be variable-color lights red, green and blue LEDs. The white light can be created by illuminating the red, green and blue LEDs with equal light outputs. At time 1, lights 1 and 2 are illuminated in white and lights 5 and 6 are illuminated in red with all electrical power going to the red LED and no power going to the green or blue LEDs. At time 2, lights 3 and 4 are illuminated in white and lights 7 and 8 are illuminated in red. At time 3, lights 1 and 2 are illuminated in red and lights 5 and 6 are illuminated in white. At time 4, lights 3 and 4 are illuminated in red and lights 7 and 8 are illuminated in white. This directional movement can be useful if the traffic is being directed towards one side of the traffic cone. Because the light colors change, the flash pattern signals transmitted to the light boards must include power settings for each of the red, green and blue LEDs in each of the lights so that the proper color is emitted by each light.

TABLE 3

| | Light 1 | Light 2 | Light 3 | Light 4 | Light 5 | Light 6 | Light 7 | Light 8 |
|---|---|---|---|---|---|---|---|---|
| Time 1 | On White | On White | Off | Off | On Red | On Red | Off | Off |
| Time 2 | Off | Off | On White | On White | Off | Off | On Red | On Red |
| Time 3 | On Red | On Red | Off | Off | On White | On White | Off | Off |
| Time 4 | Off | Off | On Red | On Red | Off | Off | On White | On White |

Three examples of flash patterns have been described above. However, an infinite number of other flash patterns can developed and used by the inventive cone lights. In some embodiments, the end user may be able to develop their own flash patterns and then store these patterns in the memory 137 of the master light control board 135. Although the flash patterns have been described as digital information stored in the memory 137, in other embodiments, the flash patterns can be electrical circuits which can electrically coupled to the lights 115 to provide simple illumination flash patterns.

The power supplies 165 can be a battery such as a rechargeable AA size battery. Because the battery can have a limited amount of power that it can emit, the cone light can have a limited time of operation. For example, if the batter can provide 2500 mAH of electrical power and the eight LEDs each draw 20 mA of power, the battery would be able to continuously illuminate the eight LEDs for 15.6 hours. The flash pattern can alter the power required by the cone light and therefore the operating time of the cone light can be controlled by the flash pattern. For example, a flash pattern which only illuminates four LEDs simultaneously at any time period may power the eight LEDs for 31.2 hours. Similarly, if the flash pattern only illuminates two LEDs at any time period, the battery can last up to 62.4 hours. LEDs can be more light output efficient or brighter when operating at cooler temperatures. By flashing the LEDs rather than running them continuously which produces more heat, the operating efficiency of the light cone is further improved.

With reference to FIGS. 2 and 3, in some embodiments, the cone light 101 can include components that may further extend the life of a battery power supply. For example, in outdoor applications, the cone light 101 might be configured to only illuminate the lights at night. The cone light 101 can include a light sensor 151 mounted on a top surface that detects the ambient light. If the ambient light is above a predetermined level, such as during the day time, the cone light 101 can stop illuminating the lights during the day time. As day turns to night, the light sensor 151 can also determine if the ambient light is below the predetermined level and allow the cone light 101 to illuminate the lights 115 at night when it becomes dark. In order to further extend the life of the batteries, one or more solar cells 155 can be coupled to the top surface of the cone light 101. The solar cell 155 can convert solar energy into electrical power which can then be used to recharge the batteries during the day when the lights 115 may not be illuminated.

In another embodiment, the cone light 101 may use motion sensors 157 to conserve electrical power. The cone light 101 may have one or more motion sensors 157 mounted around the body 103. Each of the one or more motion sensors 157 can be in communication with the master light control board. If the cone light 101 is being used in an isolated location having low traffic and few people in the area, continuous illumination may not be required. The cone light 101 may normally be in a "sleep" mode with the lights off or more dimly illuminated. When one or more motion sensors 157 detect the presence of a moving object such as a car or people in the area, the cone light 101 may immediately fully illuminate the lights. The lights may remain fully illuminated for a predetermined period of time after the motion sensors 157 have stopped detecting movement.

In some applications, it may only be necessary to detect movement on one side of the cone light 101. If the motion sensors 157 do not surround the entire circumference, the cone light 101 can be oriented with the sensors facing the area where movement is to be detected. Alternatively, if the motion sensors 157 surround the entire cone light 101, it may be possible to disable some of the motion sensors 157 that face away from the area where movement is to be detected. The motion sensors 157 can be disabled with individual switches that prevent communications with the master light control board or by placing an opaque cover over the disabled motion sensors 157.

With reference to FIG. 4, in an embodiment, the cone light 101 can also have a charging port 159 through which the batteries can be coupled to an external power supply 162 such as an AC charger or a back-up power supply. In an embodiment, it is also possible to remove the batteries from the cone light 101 when they have worn out and replace the batteries. The power from the batteries on each of the light boards may be combined so that all of the lights are powered by the combination of batteries in the cone light 101. Thus, all lights 113 can be illuminated uniformly. In another embodiment, each light board 131, 135 has its own battery and if a single battery is drained only the lights 115 coupled to the light board 131 having the dead battery will cease to be illuminated.

Figure 8:
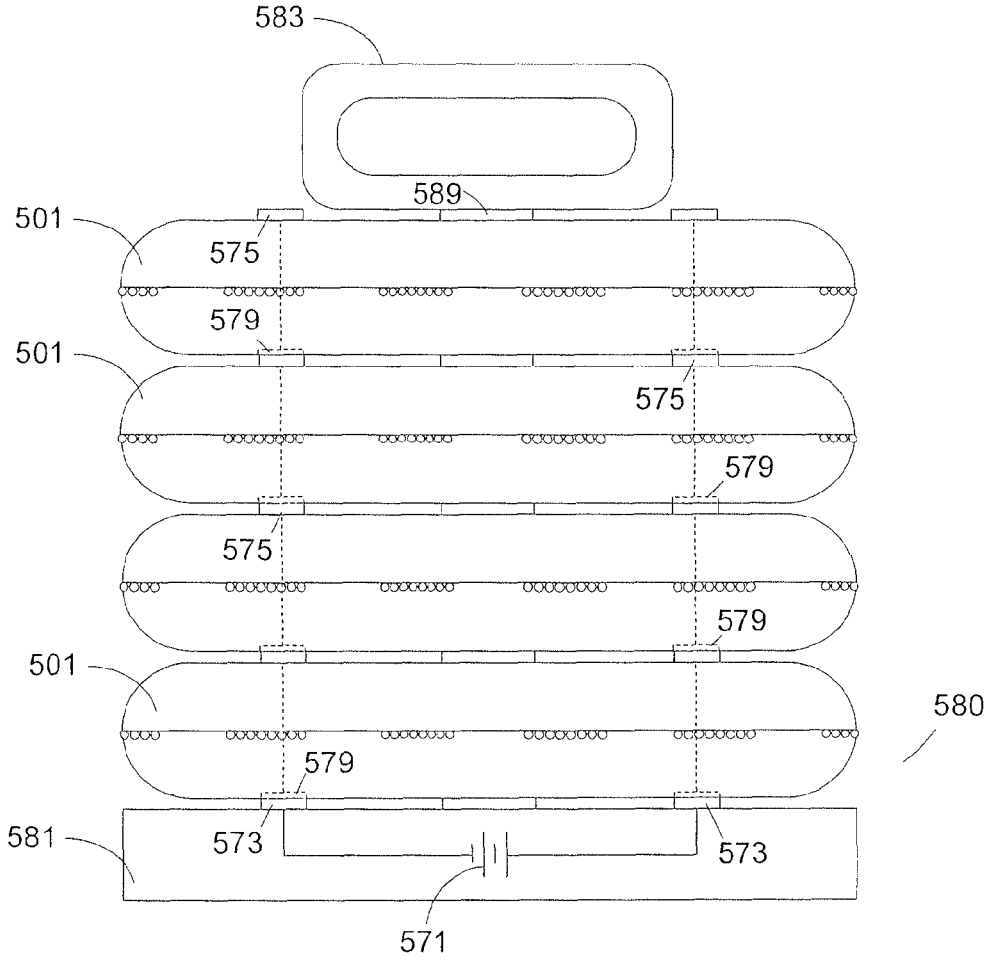
FIG. 8 illustrates a side view of a charging station for the cone lights.

With reference to FIG. 8, in an embodiment, the cone lights 501 may include rechargeable batteries, charging electrodes 579 on a lower surface and output electrodes 575 on an upper surface. In this embodiment, the batteries of the cone lights 501 can be recharged by stacking the cone lights 501 on a charging station 580. The charging station 580 can include a base 581, a handle 583, a support rod 589, and an electrical power source 571 that are coupled to the charging contacts 573. The handle 583 is coupled to the base 581 by the rod 589. A first cone light 501 can be placed on the base 581 with the charging electrodes 579 in contact with the charging contacts 573. Additional cone lights can be stacked on the first cone light with their charging electrodes 579 in contact with the lower output electrodes 575. The cone lights 501 are placed around the support rod 589. In this configuration, the batteries in each of the stacked cone lights 501 can be charged simultaneously. A user can easily move the cone lights 501 by lifting the charging station 580 by the handle 583 to transport the stacked cone lights 501.

Figure 9:
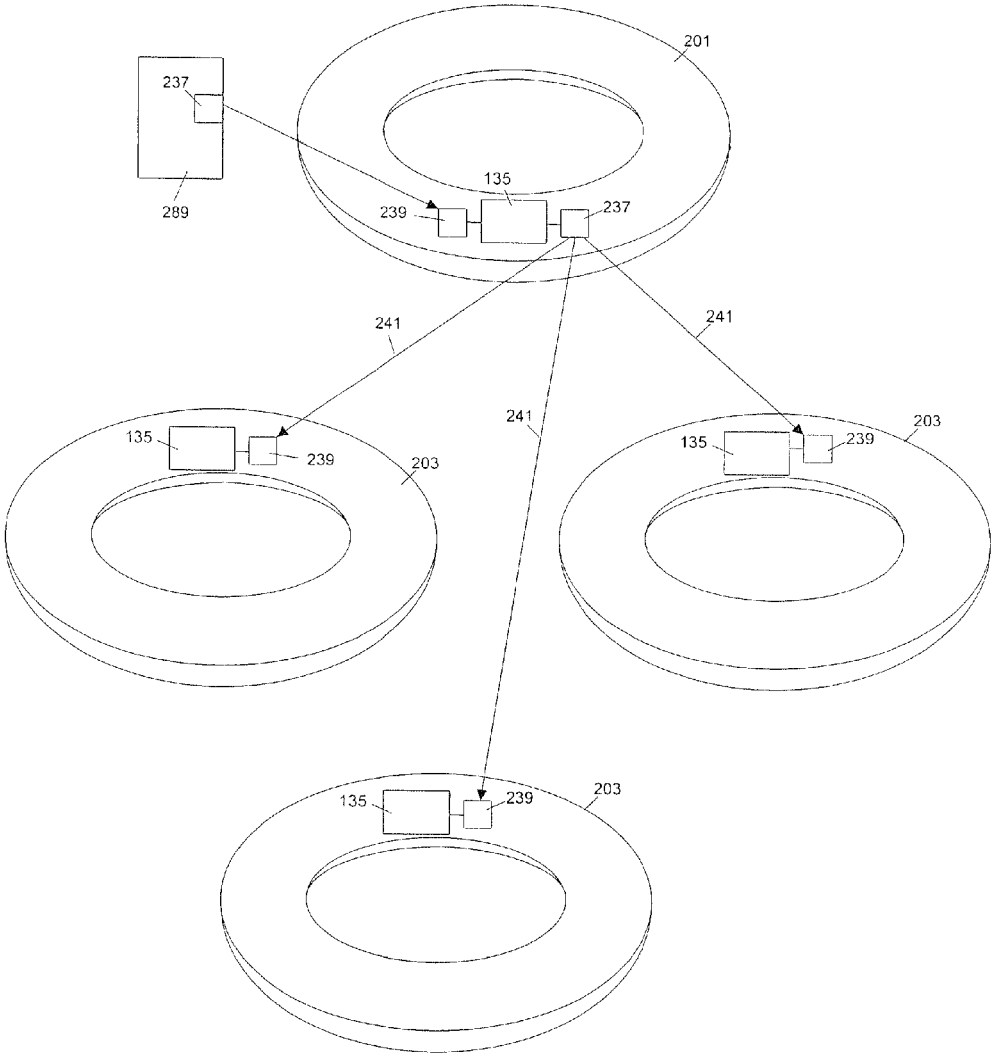
FIGS. 9 and 10 illustrate a master cone light and a plurality of slave cone lights.

Although the cone light has been described as an independent structure, in other embodiments, the cone lights may function in combination and communicate with each other wirelessly. As discussed above with reference to FIG. 7, in an embodiment, the cone lights can have a master/slave switch 184 which allows each of the cone lights to be set to be either a master cone light or a slave cone light. A cone light system may include one master cone light and one or more slave cone lights With reference to FIG. 9 a system of cone lights may include one cone light set as a master cone light 201 and one or more cone lights which are set as slave cone lights 203. The master light control board 135 in the master cone light 201 may include a wireless transmitter 237. The flash pattern can be set for the master cone light 201 and the lights coupled to the master light control board 135 and the other light boards can illuminate the lights in the set flash pattern as described above. The master light control board 135 can also transmit flash pattern signals 241 from the wireless transmitter 237 to receivers 239 in each of the slave cone lights 203. The master light control boards 135 in each of the slave cone lights 203 can receive the flash pattern signals and control the slave light boards to illuminate the lights in the flash pattern set by the flash pattern signal 241.

The wireless communications between the master cone light 201 and the slave cone lights 203 can be via RF or optical signals. If RF signals are used, the transmitter 237 can be an RF transmitter which emits RF flash pattern signals to one or more RF receivers. The range of the RF flash pattern signals 241 may be limited by the power output of the transmitter 237 and all of the slave cone lights 203 should be within the transmission range of the transmitter 237.

If the wireless communications are through optical signals such as infrared (IR) optical signals, the transmission paths must be in direct line of sight since the IR signals cannot be transmitted through most translucent or opaque objects. Thus, the master cone light 201 may have multiple IR transmitters mounted around the outer diameter so that the flash pattern signals will radiate to each of the surrounding slave cone lights 203 and the slave cones 203 can have multiple IR receivers 239 mounted around the outer diameter to receive the IR flash pattern signals 241.

In yet another embodiment, the cone light system may include a remote control unit 289 which can control the flash pattern of the master cone light 201. The remote control unit 289 may provide the same functionality as the switches shown in FIG. 7 and may allow the user to remotely set to the desired flash pattern, the flash rate and the light output of the lights for the cone lights 201, 203 through a user interface. Once the desired light flash pattern settings are selected, the remote control unit 289 can transmit the flash signals from a transmitter 237 to a receiver 239 in the master cone light 201. The master cone light 201 can transmit the flash pattern signals 241 to the slave cone lights 203 as described above.

Figure 10:
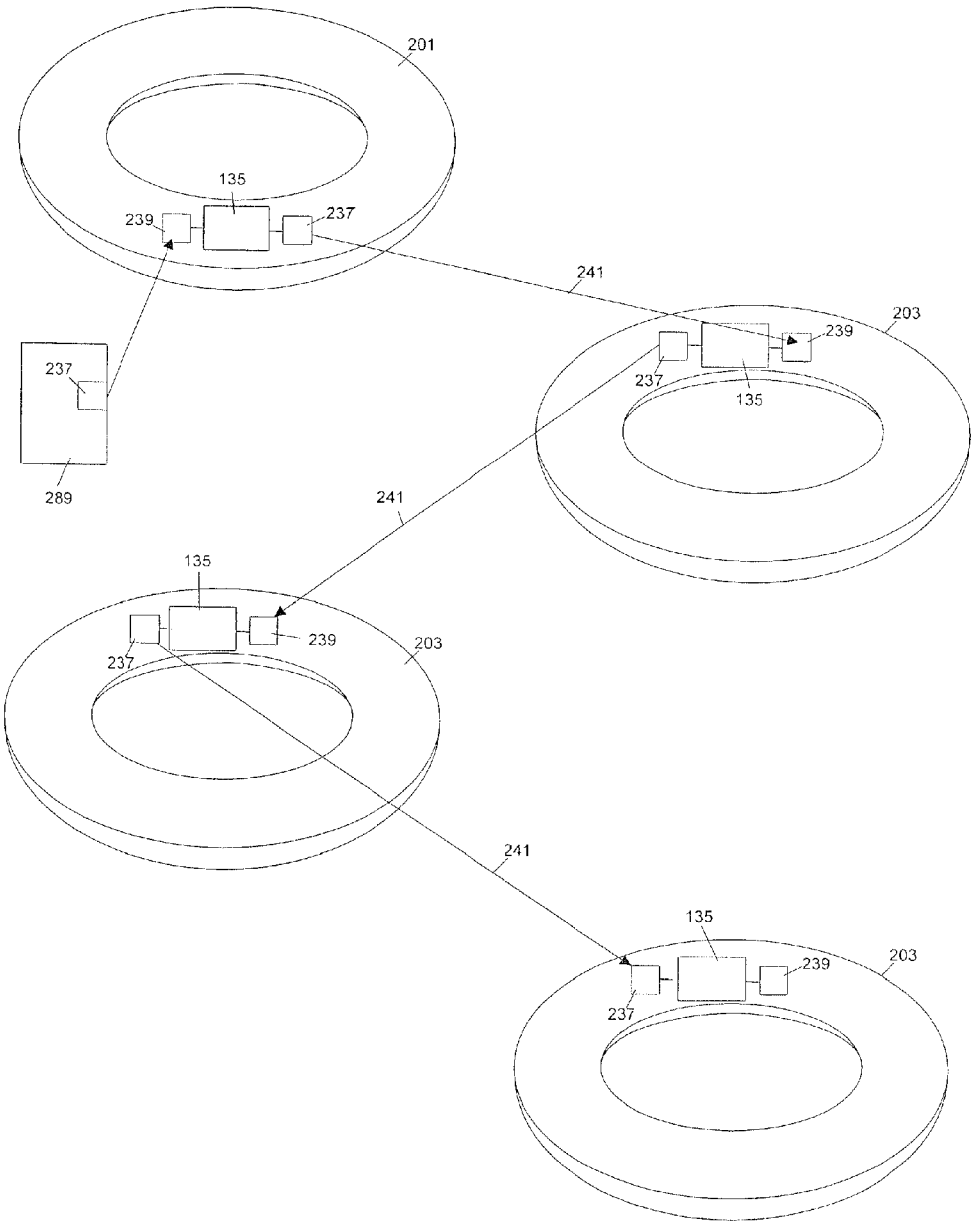

With reference to FIG. 10, in another embodiment, each of the slave cone lights 203 may include both a wireless receiver 239 and a wireless transmitter 237 which are coupled to the master light control boards 135. Rather than transmitting the flash pattern signal to each of the slave cone lights 203, the master cone light 201 may have a limited transmission range and the flash pattern signal 241 may only reach the closest slave cone light 203. The closest slave cone light 203 can receive the flash pattern signal 241, illuminate the lights in the designated flash pattern and retransmit the flash pattern signal 241 to the next slave cone light 203. This process can be repeated until all of the slave cone lights 203 have received the flash pattern signals 241. This embodiment can be useful where the distance between two adjacent cone lights 203 is within the transmission range of the wireless transmitter 239 of the master cone light 201 but the distance between to furthest cone lights 203 is the system is greater than the transmission range of the master cone light 201.

Figure 11:
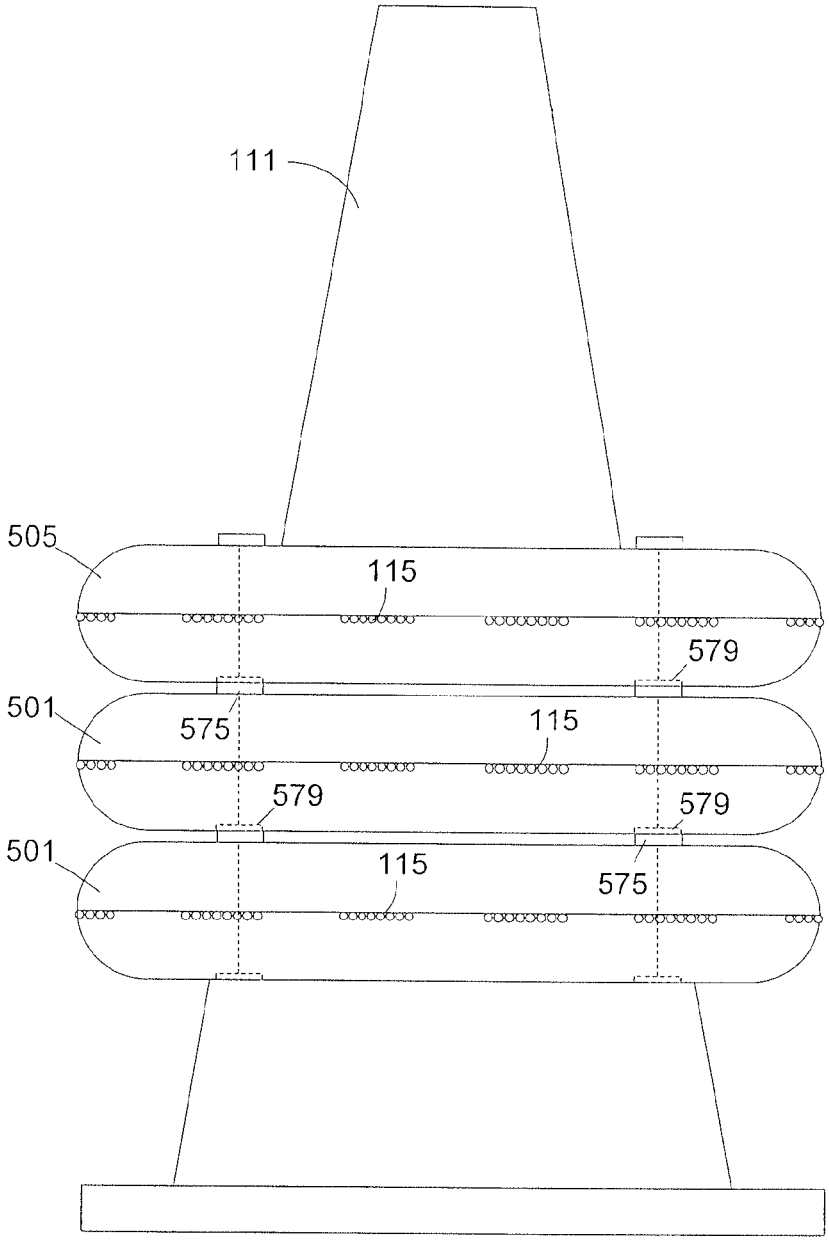
FIG. 11 illustrates a side view of a plurality of cone lights on a traffic cone.

In an embodiment, the visibility of a traffic cone can be improved by placing a plurality of cone lights on a single traffic cone. With reference to FIG. 11, in an embodiment, a plurality of slave cone lights 501 and a master cone light 505 can be placed on a traffic cone 111 with the electrodes 575, 579 of the adjacent cone lights 501, 505 in direct physical contact. In this embodiment, the master cone light 505 may transmit the flash pattern signals through the electrodes 579 to the electrodes 575 of the adjacent slave cone light 101 as well as the electrodes 575 of the lower slave cone light 501. The lights 115 of all of the cone lights can be illuminated in the selected flash pattern as described. Alternatively, the flash pattern signals can be RF or optical signals that are transmitted from the master cone light 505 to the slave cone lights 501 as described above.

It will be understood that the inventive system has been described with reference to particular embodiments, however additions, deletions and changes could be made to these embodiments without departing from the scope of the inventive system. Although the systems that have been described include various components, it is well understood that these components and the described configuration can be modified and rearranged in various other configurations.

What is claimed is:

1. A cone light apparatus comprising:

a) a body at least partially surrounding an open center portion;

b) a plurality of lights coupled to an outer surface of the body;

c) a master light control board within the annular body, the master light control board having a memory for storing a plurality of flash patterns and a micro-controller for controlling the illumination of the plurality of lights; and d) a flash pattern selector attached to the body and coupled to the master light control board for selecting one of the plurality of flash patterns and causing the master light control board to illuminate the plurality of lights in the flash pattern set by the flash pattern selector.

2. The cone light apparatus of claim 1 wherein the plurality of lights include a first group of lights and additional groups of lights, the first group of lights is coupled to the master light control board and each of the additional groups of lights is coupled one of a plurality of slave light boards within the annular body, the master light control board transmits a flash pattern signal to the slave light boards.

3. The cone light apparatus of claim 2 wherein the first group of lights and the additional groups of lights are illuminated simultaneously.

4. The cone light apparatus of claim 2 wherein the first group of lights and the additional groups of lights are illuminated sequentially.

5. The cone light apparatus of claim 1 wherein the lights are LEDs.

6. The cone light apparatus of claim 1 wherein each of the plurality of lights includes a red LED, a green LED and a blue LED and each of the plurality of lights is capable of emitting a plurality of colors.

7. The cone light apparatus of claim 1 wherein the flash patterns includes a plurality of different colors for the plurality of lights.

8. The cone light apparatus of claim 1 further comprising:

a motion sensor coupled to the controller;

wherein the controller sets a first flash pattern for the master control board when motion is detected and the controller sets a second flash pattern for the master control board when motion is not detected.

9. The cone light apparatus of claim 1 further comprising:

a light sensor coupled to the controller;

wherein the controller sets a first flash pattern for the master control board when an ambient light is detected to be above a predetermined level and the controller sets a second flash pattern for the master control board when the ambient light is detected to be below the predetermined level.

10. The cone light apparatus of claim 1 further comprising:

a rechargeable battery mounted within the body; and a solar charger mounted to an upper surface of the body for recharging the battery.

11. A cone light apparatus comprising:

a) a body at least partially surrounding an open center portion;

b) a plurality of lights coupled to an outer surface of the body;

c) a master light control board within the annular body, the master light control board having a memory for storing a plurality of flash patterns and a micro-controller for controlling the illumination of the plurality of lights;

d) a flash pattern selector attached to the body and coupled to the master light control board for selecting one of the plurality of flash patterns and causing the master light control board to illuminate the plurality of lights in the flash pattern set by the flash pattern selector; and e) a transmitter coupled to the micro-controller for transmitting a flash pattern signal that corresponds to the flash pattern selected by the flash pattern selector.

12. The cone light apparatus of claim 11 wherein the plurality of lights include a first group of lights and additional groups of lights, the first group of lights is coupled to the master light control board and each of the additional groups of lights is coupled one of the plurality of slave light boards within the annular body, the master light control board transmits the flash pattern signal to the slave light boards.

13. The cone light apparatus of claim 11 wherein the lights are LEDs.

14. The cone light apparatus of claim 11 wherein each of the plurality of lights includes a red LED, a green LED and a blue LED and each of the plurality of lights is capable of emitting a plurality of colors.

15. The cone light apparatus of claim 11 further comprising:

a master/slave switch coupled to the micro-controller for controlling the operating mode of the light cone.

16. A cone light apparatus comprising:

a) a body at least partially surrounding an open center portion;

b) a plurality of lights coupled to an outer surface of the body, the plurality of lights include a first group of lights and additional groups of lights;

c) a master light control board within the annular body, the master light control board having a micro-controller for controlling the illumination of the first group of lights;

d) a plurality of slave light boards within the annular body, each of the additional groups of lights is coupled one of the plurality of slave light boards; and e) a receiver coupled to the micro-controller for receiving a flash pattern signal.

17. The cone light apparatus of claim 16 wherein, the first group of lights and the additional groups of lights are illuminated in the same flash pattern.

18. The cone light apparatus of claim 16 wherein the lights are LEDs.

19. The cone light apparatus of claim 16 wherein each of the plurality of lights includes a red LED, a green LED and a blue LED and each of the plurality of lights is capable of emitting a plurality of colors.

20. The cone light apparatus of claim 16 further comprising:

a transmitter coupled to the micro-controller for transmitting the flash pattern signal.

* * * * *